US005775386A

United States Patent [19]

Connan

[11] Patent Number: 5,775,386

[45] Date of Patent: Jul. 7, 1998

[54] APPARATUS AND PROCESS FOR FILLING PLURAL CHAMBER CONTAINER WITH FLOWABLE MATERIALS

[75] Inventor: Patrick Andre Connan, Lebanon, N.J.

[73] Assignee: Colgate-Palmolive Company, New York, N.Y.

[21] Appl. No.: 662,385

[22] Filed: Jun. 13, 1996

[51] Int. Cl.[6] ..... B65B 1/04; B65B 3/04; B67C 3/02

[52] U.S. Cl. ..... 141/103; 141/2; 141/9; 141/100; 141/113; 141/114; 141/313; 141/314; 53/410; 53/469; 53/474; 222/94; 222/107

[58] Field of Search ..... 141/2, 9, 18, 113, 141/114, 100, 103, 105, 313, 314; 222/94, 107, 129, 145; 53/410, 469, 474

[56] References Cited

U.S. PATENT DOCUMENTS

| | | | |
|---|---|---|---|
| D. 277,073 | 1/1985 | Czech . | |
| D. 306,554 | 3/1990 | Lawson . | |
| D. 307,113 | 4/1990 | Thompson . | |
| D. 311,861 | 11/1990 | Vanhoutte . | |
| D. 315,496 | 3/1991 | Pettengill . | |
| D. 356,026 | 3/1995 | Iaia et al. . | |
| 1,363,064 | 12/1920 | Stegath . | |
| 1,676,734 | 7/1928 | Hopkins | 141/9 |
| 1,828,865 | 10/1931 | Hopkins . | |
| 1,894,115 | 1/1933 | Murphy . | |
| 2,103,817 | 12/1937 | Johnson . | |
| 2,107,987 | 2/1938 | Johnson . | |
| 2,517,027 | 8/1950 | Rado . | |
| 2,661,871 | 12/1953 | Huenergardt . | |
| 2,939,610 | 6/1960 | Castelli . | |
| 2,944,705 | 7/1960 | Strumor . | |
| 2,959,327 | 11/1960 | Bloom . | |
| 3,105,615 | 10/1963 | Koga . | |
| 3,166,221 | 1/1965 | Neilsen . | |
| 3,182,728 | 5/1965 | Zabriskie . | |
| 3,197,071 | 7/1965 | Kuster . | |
| 3,227,319 | 1/1966 | Rosier . | |
| 3,380,632 | 4/1968 | Wilson . | |
| 3,506,157 | 4/1970 | Dukess . | |
| 3,529,638 | 9/1970 | Angell et al. | 141/9 |
| 3,788,520 | 1/1974 | Dukess . | |
| 3,881,529 | 5/1975 | Mannara . | |

(List continued on next page.)

FOREIGN PATENT DOCUMENTS

| | | |
|---|---|---|
| 0 503 824 | 9/1992 | European Pat. Off. . |
| 0576222 | 6/1993 | European Pat. Off. . |
| 0 693 437 | 1/1996 | European Pat. Off. . |
| 3420324 | 1/1988 | Germany . |
| 43 35 970 | 4/1995 | Germany . |
| 295 15 380 U | 1/1996 | Germany . |
| 2-205501 | 8/1990 | Japan . |
| 112375 | 12/1962 | Pakistan . |
| 2142611 | 1/1985 | United Kingdom . |
| WO 94/14680 | 7/1994 | WIPO . |

*Primary Examiner*—Henry J. Recla
*Assistant Examiner*—Timothy L. Maust
*Attorney, Agent, or Firm*—Michael McGreal

[57] ABSTRACT

An apparatus and a process for filling a plural chamber container, such as a container, with plural flowable materials. The container might be a two-compartment dentifrice container or a two-compartment adhesive container, for example. The container has internal partitioning dividing it into plural chambers, and the partitioning must be properly positioned to permit supply nozzles to enter the respective chambers. In one embodiment, the partitioning is positioned by probes which are inserted into the chamber, following which relative rotation between the container and the probes causes the probes to position the partitioning. In a second embodiment, air nozzles emit air jets to position the partition. In another embodiment, an electrostatic charge is induced on the container sidewall and on the partition, and the like charges cause the sidewall and the partition to repel each other, positioning the partition. In a further embodiment, an air/vacuum nozzle is inserted into one of the container chambers, and air jets and suction are alternated to position the partition so that a supply nozzle can be inserted into each chamber of the container.

36 Claims, 6 Drawing Sheets

U.S. PATENT DOCUMENTS

| | | | |
|---|---|---|---|
| 3,948,704 | 4/1976 | Evans . | |
| 3,980,222 | 9/1976 | Hood . | |
| 4,014,463 | 3/1977 | Hermann . | |
| 4,040,420 | 8/1977 | Speer . | |
| 4,046,288 | 9/1977 | Bergman . | |
| 4,089,437 | 5/1978 | Chutter . | |
| 4,099,651 | 7/1978 | Von Winckelmann . | |
| 4,148,417 | 4/1979 | Simmons . | |
| 4,211,341 | 7/1980 | Weyn . | |
| 4,260,077 | 4/1981 | Schroeder . | |
| 4,487,757 | 12/1984 | Kiozpeoplou . | |
| 4,528,180 | 7/1985 | Schaeffer . | |
| 4,687,663 | 8/1987 | Schaeffer . | |
| 4,742,940 | 5/1988 | Wilkinson . | |
| 4,747,517 | 5/1988 | Hart . | |
| 4,773,562 | 9/1988 | Gueret . | |
| 4,819,789 | 4/1989 | Linner . | |
| 4,958,667 | 9/1990 | Rece et al. | 141/313 |
| 4,964,539 | 10/1990 | Mueller . | |
| 4,974,756 | 12/1990 | Pearson . | |
| 4,981,241 | 1/1991 | Keller . | |
| 5,020,694 | 6/1991 | Pettengill . | |
| 5,038,963 | 8/1991 | Pettengill . | |
| 5,045,305 | 9/1991 | Clarkson . | |
| 5,076,464 | 12/1991 | Simon | 220/530 |
| 5,078,963 | 1/1992 | Mallen . | |
| 5,137,178 | 8/1992 | Stokes . | |
| 5,145,668 | 9/1992 | Chow . | |
| 5,209,376 | 5/1993 | Dirksing . | |
| 5,224,627 | 7/1993 | Weag . | |
| 5,244,120 | 9/1993 | O'Meara . | |
| 5,269,441 | 12/1993 | O'Meara . | |
| 5,289,949 | 3/1994 | Gentile . | |
| 5,318,203 | 6/1994 | Iaia et al. . | |
| 5,332,124 | 7/1994 | Cancro . | |
| 5,335,827 | 8/1994 | Gentile . | |
| 5,476,647 | 12/1995 | Chow . | |

APPARATUS AND PROCESS FOR FILLING PLURAL CHAMBER CONTAINER WITH FLOWABLE MATERIALS

FIELD OF THE INVENTION

The present invention pertains to the filling of flowable materials, such as viscous, paste-like materials, into a partitioned container the interior of which is separated into a plurality of chambers to hold a plurality of reactive flowable materials without the mixing of such materials until they are dispensed from the tube and mixed for use. More particularly, the present invention pertains to an apparatus and a process for filling a container, such as a toothpaste tube or an adhesive tube, having an internal partition dividing the tube interior into two or more chambers for holding two or more materials which react when mixed, such as dentifrice components for example baking soda and peroxide or calcium phosphate and fluoride, or such as two adhesive components, for example a resin and a catalyst activator, and for dispensing proportional quantities of the materials when the tube is opened and squeezed, so as to permit mixing and application of the mixed materials in the desired proportion.

Although the invention is described in detail herein with reference to a container having two internal chambers, the invention is readily applicable to the filling of plural chamber containers having more than two chambers. Likewise, although the invention is described with reference to viscous materials such as dentifrice ingredients or adhesive ingredients, the invention may be applied to other flowable materials, including not only paste-like viscous materials but also liquids and powders.

The invention will be described with specific reference to tube containers. However, it is understood that the concepts apply equally to other containers. Tubular containers are one preferred embodiment of the useful containers but with no intent to limit the invention specifically to tubes. Therefore, when the term tubes is used it is meant to be inclusive of other multi-chamber containers.

Single component dentifrice, such as toothpaste, has long been packaged in tubes which can be uncapped at one end and squeezed from the opposite end to dispense a quantity of the dentifrice from the open end of the tube. Likewise, single component adhesives, such as glue, have long been packaged in such tubes. Two component dentifrice products have recently been prepared, but the two components have been packaged in separate tubes or similar containers to prevent their mixing until they are to be utilized. Then each of the two tubes must be uncapped and squeezed to dispense a quantity of each component from its respective tube. However, it is difficult for the user to assure that the same quantity of each component is dispensed from its respective tube. Consequently, optimum performance of such a two component dentifrice is difficult to achieve, since frequently the quantity of one component that is dispensed is too large for the quantity of the other component that is dispensed. Similar two-tube packaging of two component adhesives, such as epoxy-resin adhesives, is utilized, and a similar problem arises in dispensing the proper proportion of the two components of the adhesive, with the result that the optimum strength of bond is often not obtained.

A single tube having two concentric chambers within it to separate two viscous materials is shown in, for example, U.S. Pat. Nos. 1,676,734 and 1,828,865. Such tubes are not altogether satisfactory because the rigidity of the tube inner chamber prevents squeezing of the tube outer chamber from discharging the proportionate amounts of material from the outer and inner chambers.

While a two chamber tube can be provided by extending a partition down the center of the tube, the partition must be of a thin, highly flexible material, and during the manufacturing process when the tube is to be filled, often the partition is not properly positioned, but instead is in a position that inhibits a device such as a filling nozzle from entering one of the chambers at the proper time. One end of the tube is closed with a shoulder, stem, and cap which can be opened by means of a hinged arrangement. The shoulder and stem likewise have a partition which is attached to the partition within the tube. Such tubes are generally substantially oval or substantially circular in cross-section. After the tube is filled, its second end is crimp sealed. This crimping and sealing flattens that end of the tube, with the result that its major cross-sectional dimension exceeds the diameter or other cross-sectional dimension of the unfilled tube. The partition in one orientation must extend across the entire width of the flattened and crimped end. This is one reason why the partition preferably is wider than the cross-section of the remainder of the tube. Another reason is that a partition that is greater than the diameter provides for a more controlled dispensing of the products in the chambers from the tubular container. As a result, although the partition may extend across substantially the center of the tube adjacent the crimped and widened end of the tube, over the major portion of the tube length the extra width of the partition causes the partition to be curled within the tube and at a randomly determined position, which may be near the tube sidewall.

The two materials are filled into the respective two chambers of the tube by inserting a supply nozzle into each chamber and discharging the viscous material while withdrawing the nozzle from the chamber so that the discharge end of the nozzle remains slightly above the level of the viscous material during filling. However, if the partition is near the tube sidewall, it may not be possible for both supply nozzles to properly enter the two chambers within the tube. Therefore, it is necessary to properly position the partition before inserting the supply nozzles for the viscous materials.

SUMMARY OF THE INVENTION

The present invention is an apparatus and a process for filling a two or more chamber tube with two viscous materials, such as dentifrice components like baking soda and peroxide or adhesive components like a resin and an activator. In accordance with the present invention, the tube can be held in a jig, puck or other holder, and the tube partition is positioned by two positioning probes, or by a single positioning probe, that are brought adjacent the open end of the tube or through the open end of the tube into the two or more chambers and are utilized to move the partition to the desired diametrical position, permitting the supply nozzles to enter the respective chambers. Various positioning probes might be utilized in accordance with the present invention.

In one embodiment, a positioning probe is inserted on each side of the tube partition, and then either the two probes or the tube and partition are rotated to cause the probes to properly position the partition.

In an alternative embodiment, the positioning probes take the form of two air nozzles which can be positioned, one on each side of the tube partition, so that air jets from the two air nozzles can be utilized to position the partition as desired.

In another embodiment, two electrical probes are brought into contact with the tube sidewall and the internal partition to impart an electrostatic charge to the surfaces of the tube sidewall and the partition so that the like charges on the two surfaces repel the partition from the tube sidewall to a position across substantially the center of the tube.

In a further alternative embodiment, a single probe having air/vacuum nozzles adjacent its end is utilized to blow brief jets of air against the partition to move the partition from the tube sidewall. The probe can then be inserted into the thus-opened chamber, following which a vacuum is applied to the probe to draw suction through the nozzle so as to attract the partition, opening the opposite chamber for insertion of a supply nozzle into it. Air is again blown through the air nozzles to open the second chamber, permitting insertion of the second supply nozzle into it.

Once the partition is properly positioned to permit insertion of the two supply nozzles into the two chambers, the two viscous materials can be discharged into the open ends of the chambers to fill the two chambers of the tube. The open end of the tube is then sealed, for example, by crimping with heat sealing.

When the dentifrice, or other flowable material, is to be used, the cap is opened and the tube squeezed, causing a set quantity of each material to be discharged from the chambers of the tube. The position of the interior partition within both the tube body and the tube shoulder and nozzle can be selected along with material rheologies so that the two materials are dispensed in the desired ratio, whether equal or otherwise.

BRIEF DESCRIPTION OF THE DRAWINGS

These and other aspects and advantages of the present invention are more apparent from the following detailed description and claims, particularly when considered in conjunction with the accompanying drawings, in which like parts bear like reference numerals. In the drawings:

DETAILED DESCRIPTION OF THE PREFERRED EMBODIMENT

Figure 1:
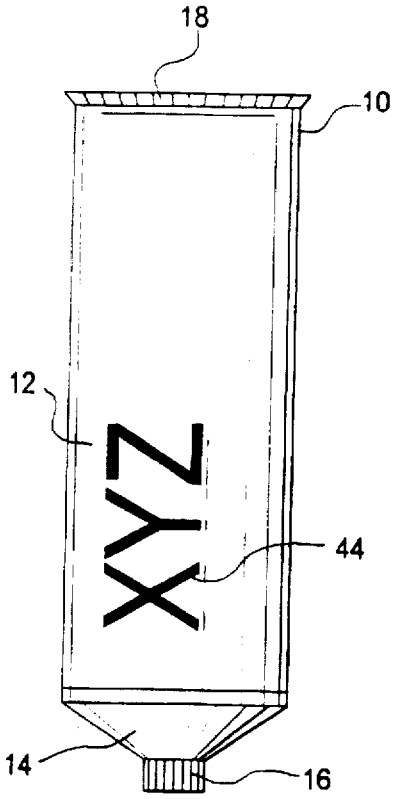
FIG. 1 is a front elevational view of a two chamber tube such as might be filled by an apparatus and a process in accordance with the present invention.
Figure 2:
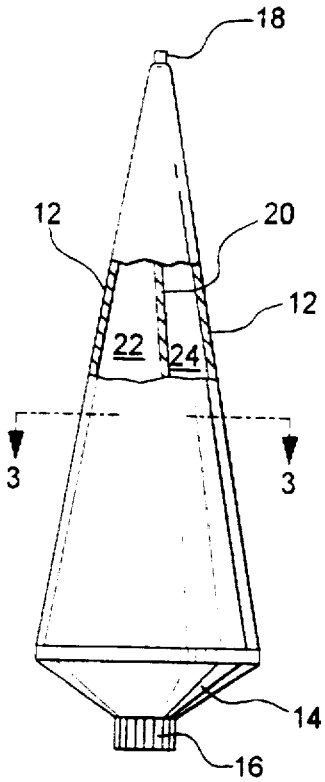
FIG. 2 is a side elevational view, partially broken away, of the tube of FIG. 1.

FIGS. 1 and 2 depict a two chamber tube 10 which includes a tubular side wall 12. Tube 10 has a first end 14 which terminates in a shoulder and stem that is closed by a cap 16, and a second end 18, which is closed, for example by crimping and heat sealing in a well known manner. A flexible partition 20 extends within tube 10 from first end 14 to second end 18 to divide the interior of tube 10 into two chambers 22 and 24.

Figure 3A:
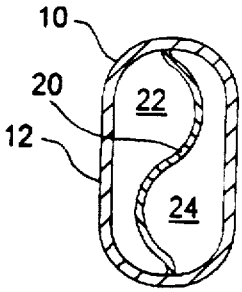
FIGS. 3A and 3B are cross-sectional views taken along line 3—3 in FIG. 2 and depicting the tube partition in alternative conditions.
Figure 3B:
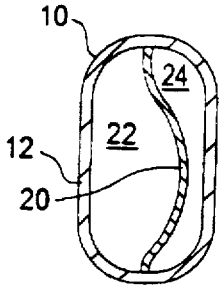

Since second end 18 of tube 10 is closed, as by crimping with heat sealing, the closed end is wider than the internal cross section of the remaining length of tube 10. In order to maintain the two materials separated within tube 10, the interior partition 20 must be of a width at least that of the cross section of tube 10, including fully across the greater width of the crimped seal of the second end 18. The interior partition 20 also must be flexible so that upon squeezing the tube to dispense the material, the energy applied to the tube surface is readily transmitted across the interior partition. A width greater than the internal cross-section aids in controlling the dispensing from the tube. Consequently, the width of interior partition 20 is greater than the internal cross section of tube 10 over the full or a major portion of the length of the tube. Therefore, over the major portion of the length of tube 10, interior partition 20 flexes, as illustrated, for example, in FIGS. 3A and 3B. For this purpose, and for uniform dispensing, the interior partition 20 is made of a thin, highly flexible material such as a plastic sheeting. In flexing within tube 10, partition 20 might assume any orientation within the unfilled tube. Thus, FIG. 3A illustrates partition 20 in a somewhat sinusoidal configuration near the center of the interior of tube 10, while alternatively FIG. 3B illustrates partition 20 adjacent an interior sidewall of tube 10. In the position of FIG. 3B, partition 20 might prevent a supply nozzle from properly entering chamber 24.

Figure 4:
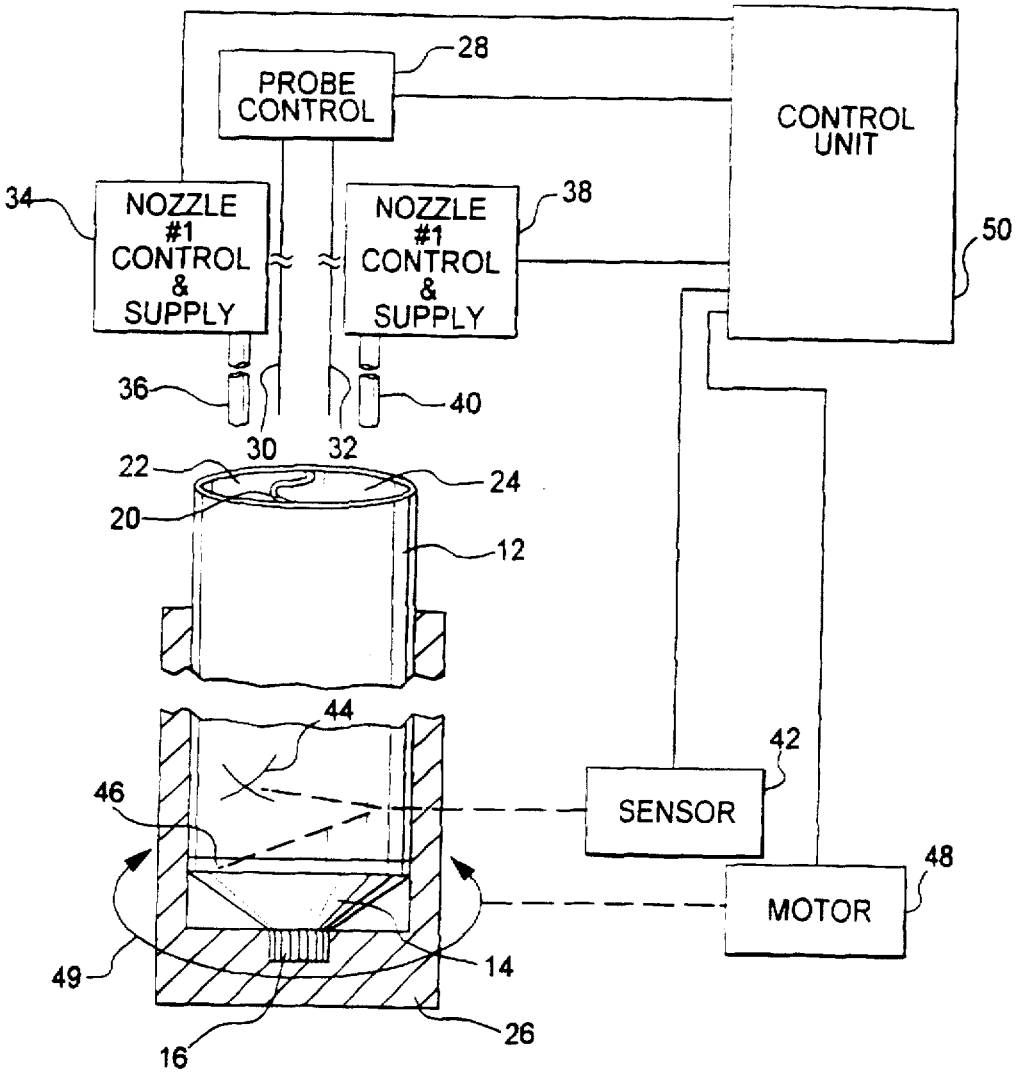
FIG. 4 diagrammatically depicts an apparatus in accordance with the present invention for filling a two chamber tube by a process in accordance with the present invention.

FIG. 4 depicts an apparatus in accordance with the present invention for filling a two chamber tube by a process in accordance with the present invention. The tube 10 is positioned within a holder 26 which maintains the tube 10 in position during filling. Holder 26 might extend substantially the full length of tube 10, as depicted in FIG. 4, so as to provide support for the sidewall 12, or might extend only a short distance up the sidewall 12. A probe control 28 controls the position of two probes 30, 32 to bring the probes adjacent the open end of the two chambers 22, 24 within tube 10. A first nozzle control and supply unit 34 controls the position of a first supply nozzle 36 to lower the discharge end of that nozzle into chamber 22 and to control the discharge of a first viscous material through nozzle 36 into chamber 22. Similarly, a second nozzle control and supply unit 38 controls the position of a second supply nozzle 40 to lower the discharge end of that nozzle into chamber 24 and to control the discharge of a second viscous material through nozzle 40 into chamber 24.

To permit detection of the orientation of tube 10 and partition 20 relative to probes 30, 32 and supply nozzles 36, 40, a sensor 42, which might be an optical detector, detects indicia on tube 10, such as printing 44 on tube sidewall 12 or such as an indentation or a projection 46 on the shoulder of closed end 14. Motor 48 then rotates tube holder 26, and thus tube 10, to the desired orientation, as indicated by arrow 49. Control unit 50 provides overall control of the apparatus, including probe control 28, first nozzle control and supply 34, second nozzle and supply 38, sensor 42 and motor 48, all of which are connected to control unit 50. Control unit 50 might be a properly programmed CPU, for example. If desired, one or more additional detectors can be used to detect the position of internal partition 20 adjacent the open end of tube 10.

The flexible tube sidewall 12 may be somewhat folded within holder 26 which also could prevent supply nozzles 36, 40 from properly entering chambers 22, 24. To avoid this, probes 30, 32 can be inserted into chambers 22, 24, respectively, and then either the two probes rotated by probe control 28 or holder 26 and tube 10 rotated by motor 48 so that the probes 30, 32 so as to bring the tube sidewall 12 adjacent the internal wall of holder 26, causing the shape of tube 10 to conform to the internal configuration of holder 26.

If such conforming of the tube to the holder configuration is not necessary, then holder 26 might extend upward only slightly above the shoulder and stem of closed end 14.

Probes 30, 32 are to be lowered to insert the ends of the two probes into, or adjacent the upper end of chambers 22, 24, respectively. However, because internal partition 20 may be adjacent the interior surface of sidewall 12 as depicted in FIG. 3B, probes 30 and 32 are positioned to be very close to the interior sidewall and on opposite sides of partition 20. Thus, the probes may best be positioned adjacent the sidewall and near the two ends of interior partition 20.

Figure 5A:
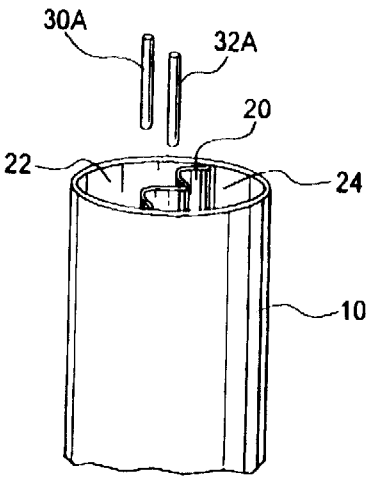
FIGS. 5A–5F depict a first embodiment of an apparatus in accordance with the present invention for filling a two chamber tube by a process in accordance with the present invention.
Figure 5B:
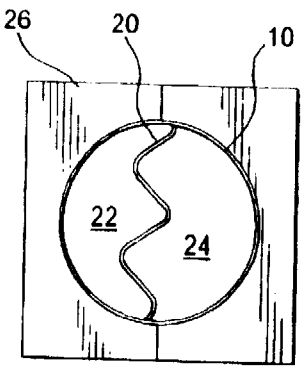
Figure 5C:
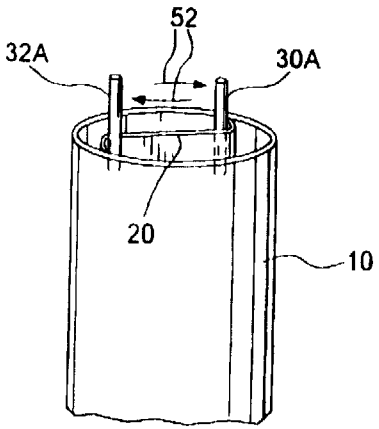
Figure 5D:
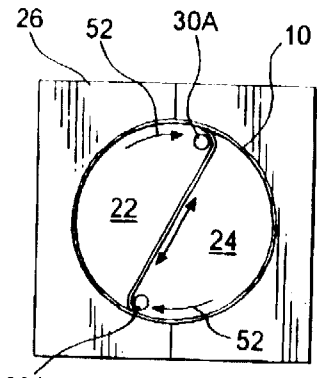
Figure 5E:
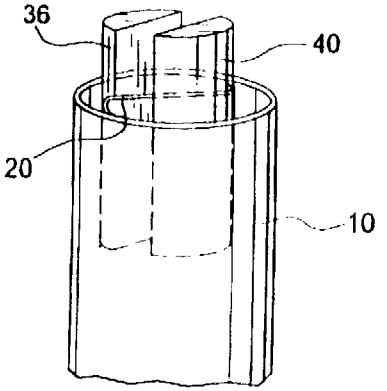
Figure 5F:
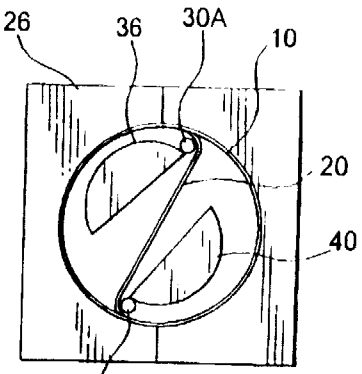

FIGS. 5A–5F illustrate a first embodiment of apparatus in accordance with the present invention for filling a two chamber tube by a process in accordance with the present invention. FIGS. 5A and 5B are, respectively, a fragmentary perspective view and a top plan view of this first embodiment of the apparatus of FIG. 4 at a first time point in the process in accordance with this first embodiment. FIG. 5A shows probes 30*a*, 32*a* about to be inserted into chambers 22, 24, respectively. FIGS. 5C and 5D are, respectively, a fragmentary perspective view and a top plan view at a later time point in this process and show probes 30*a*, 32*a* inserted into chambers 22, 24. Probe control 28 is then activated to cause probes 30*a*, 32*a* to pivot about the longitudinal axis of tube 10, as indicated by arrows 52 in FIGS. 5C and 5D, stretching partition 20 across the center of the tube and opening the entrances to the chambers 22, 24. While partition 20 is thus positioned, nozzle controls 34, 38 cause supply nozzles 36, 40 to be inserted into chambers 22, 24, respectively, as illustrated in FIGS. 5E and 5F which, are respectively, a fragmentary perspective view and a top plan view of tube 10 with supply nozzles 36, 40 inserted in the chambers. Supply nozzles 36, 40 are inserted until their outlet ends are adjacent the closed end 14 of tube 10.

Nozzle control and supply units 34, 38 then cause the two viscous materials to be discharged through supply nozzles 36, 40 into chambers 22, 24, respectively. As the viscous materials fill the chambers 22, 24, supply nozzles 36, 40 are raised to keep the outlet of each supply nozzle above the level of the viscous material in its respective chamber 22, 24.

Figure 6A:
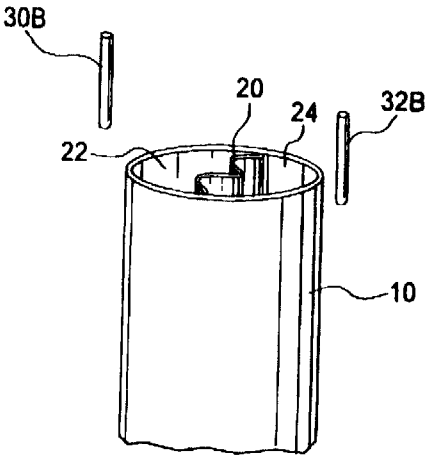
FIGS. 6A–6F depict an alternative embodiment of an apparatus in accordance with the present invention for filling a two chamber tube by a process in accordance with the present invention.
Figure 6B:
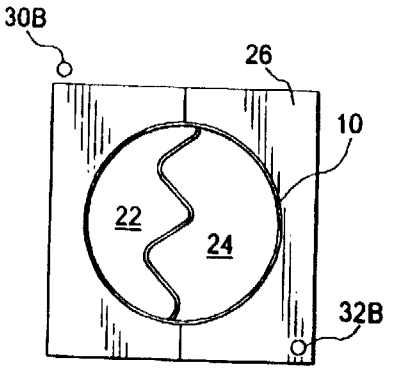
Figure 6C:
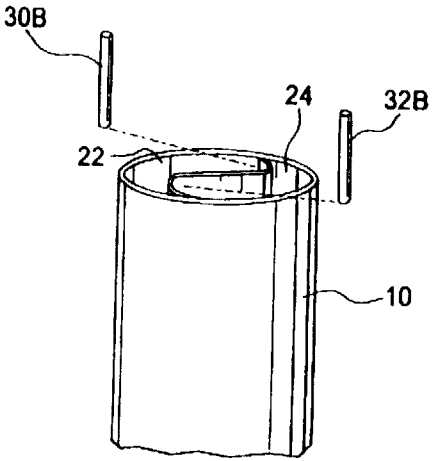
Figure 6D:
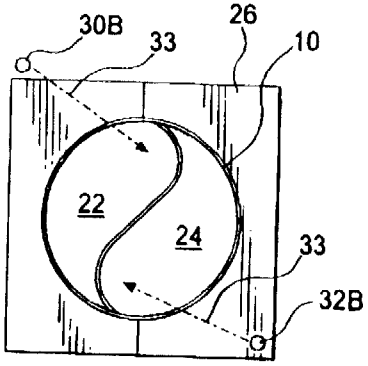
Figure 6E:
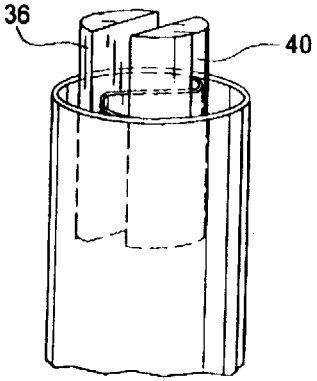
Figure 6F:
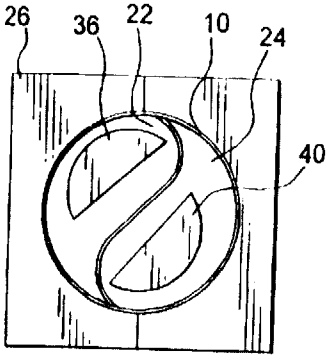

FIGS. 6A–6F illustrate another embodiment of apparatus in accordance with the present invention for filling a two chamber tube by a process in accordance with the present invention. FIGS. 6A and 6B, FIGS. 6C and 6D, and FIGS. 6E and 6F are respectively fragmentary perspective views and top plan views of the apparatus at three different time points in the process. Probes 30*b*, 32*b* of this embodiment have air jet nozzles at their lower ends. In FIGS. 6A and 6B probes 30*b* and 32*b* are brought adjacent the open ends of chambers 22, 24, respectively. Arrows 33 in FIGS. 6C and 6D illustrate jets of air being discharged from the air nozzles at the ends of probes 30*b*, 32*b*. The air jets position interior partition 20 across substantially the center of tube 10, as illustrated in FIGS. 6C and 6D. Supply nozzles 36, 40 are then inserted into chambers 22, 24. FIGS. 6E and 6F show supply nozzles 36, 40 in chambers 22, 24, respectively, preparatory to discharge of the two viscous materials into chambers 22, 24.

Figure 7C:
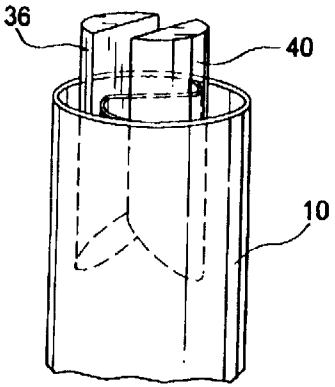
FIGS. 7A–7D depict another alternative embodiment of an apparatus in accordance with the present invention for filing a two chamber tube by a process in accordance with the present invention.
Figure 7D:
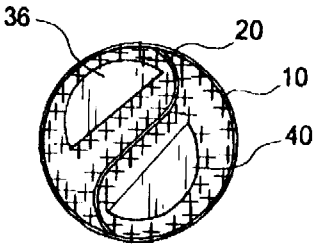
Figure 7A:
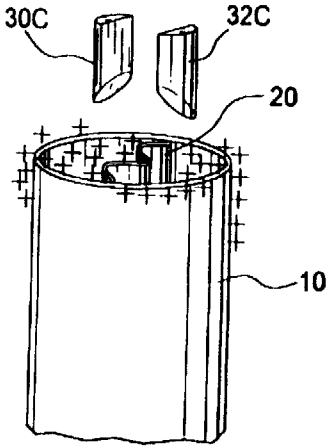
Figure 7B:
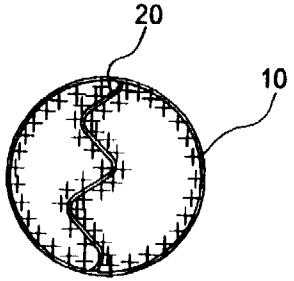

FIGS. 7A–7D are similar sets of views of another alternative embodiment of apparatus in accordance with the present invention for filling a two chamber tube by a process in accordance with the present invention. Probes 30*c* and 32*c* are connected to an electrostatic source in probe control 28, causing like electrostatic charges on probes 30*c*, 32*c*. The electrostatic charges on probes 30*c* and 32*c* induce an electrostatic charge on the interior surface of sidewall 12 and on the surfaces of interior partition 20, as illustrated in FIGS. 7A and 7B. Because these surfaces have like charges on them, the surfaces repel each other, moving interior partition 20 away from sidewall 12, toward the center of tube 10, to open chambers 22, 24 so that supply nozzles 36, 40 can enter the chambers as illustrated in FIGS. 7C and 7D. If desired, probes 30*c*, 32*c* can contact the interior of the sidewall 12 of tube 10 and the surface of interior partition 20 facing the interior sidewall surface.

Rather than inducing charges directly on the interior surface of sidewalls 12 and on the surfaces of partition 20, probes 30*c*, 32*c* can contact supply nozzles 36, 40 so that the supply nozzles themselves are charged and cause like charges on the interior surface of sidewall 12 and on the surfaces of partition 20, so that the partition moves away from sidewall 12, permitting the supply nozzles 36, 40 to enter chambers 22 and 24.

Figure 8A:
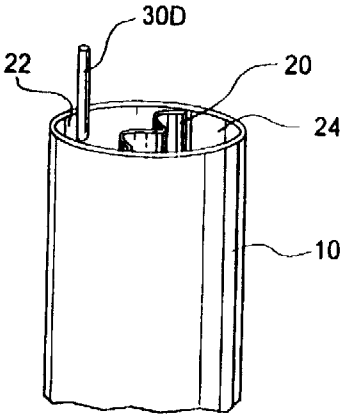
FIGS. 8A–8J depict a further alternative embodiment of an apparatus in accordance with the present invention for filling a two chamber tube by a process in accordance with the present invention.
Figure 8B:
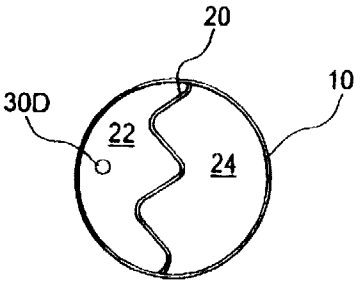
Figure 8I:
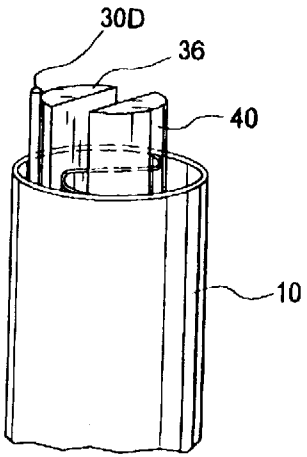
Figure 8J:
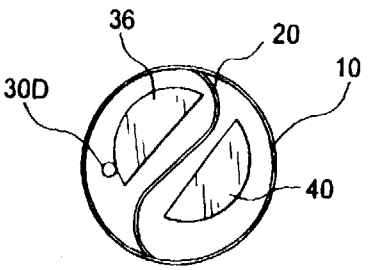
Figure 8G:
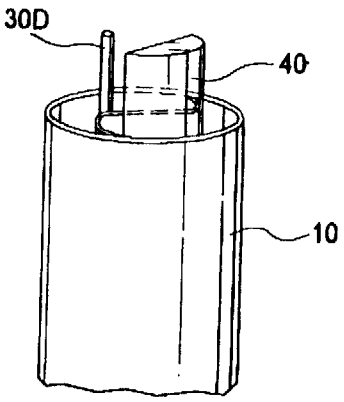
Figure 8H:
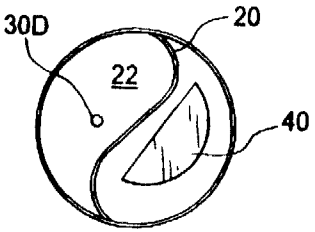
Figure 8E:
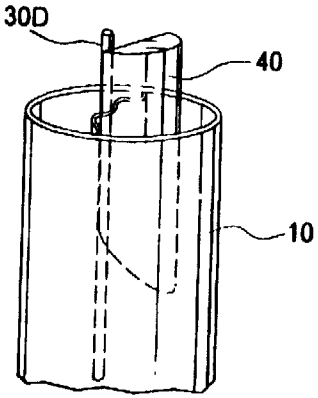
Figure 8F:
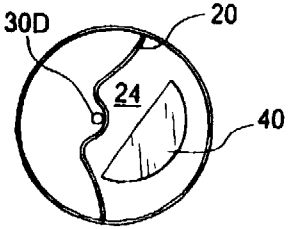
Figure 8C:
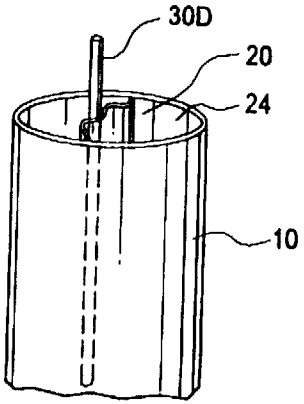
Figure 8D:
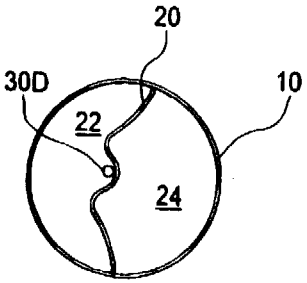

FIGS. 8A–8J depict a further embodiment of apparatus in accordance with the present invention for filling a two chamber tube by a process in accordance with the present invention. In this embodiment, the positioning of interior partition 20 is controlled by a single air/vacuum probe 30*d* having a number of nozzles adjacent its end. When partition 20 is to be positioned, probe 30*d* is inserted into one of the chambers 22, 24 as illustrated in FIGS. 8A and 8B which depict probe 30*d* in chamber 22. If necessary, air can be blown through the nozzles at the end of probe 30 to move partition 20 so that the probe can enter chamber 20. Probe control 28 then applies suction through the nozzles at the end of probe 30*d*, drawing partition 20 about probe 30*d* as illustrated in FIGS. 8C and 8D. This opens chamber 24, permitting supply nozzle 40 to be inserted into it, as illustrated in FIGS. 8E and 8F. Probe control 28 then cause brief bursts of air to be blown from the nozzles of probe 30*d* to blow partition 20 adjacent supply nozzle 40, opening chamber 22 as illustrated in FIGS. 8G and 8H. Supply nozzle 36 can then be inserted into interior chamber 22, as illustrated in FIGS. 8I and 8J.

If desired, two air nozzles or two vacuum nozzles can be used alternately in chambers 22 and 24, rather than alternately applying vacuum and air with a single nozzle 30*d*.

It can thus be seen that the present invention provides an apparatus and a process for filling two flowable materials into a tube having an internal partition extending between the two ends of the tube to provide two chambers that maintain the two materials separated within the tube until the materials are dispensed for use. Although the present invention has been described with reference to preferred embodiments, rearrangements and modifications can be made, and still the result would be within the scope of the invention.

What is claimed is:

1. Apparatus for filling a plurality of flowable materials into a container having a sidewall, a closed end, an open end, and at least one internal flexible partitioning extending between the closed end and the open end to divide the container interior into a plurality of chambers so as to maintain the plurality of materials separated within the container, said at least one flexible partitioning having a first and a second side edge, each side edge attached to said sidewall, said internal flexible partitioning having a transverse dimension greater than the linear distance of the first side edge attachment to said sidewall and said second side edge attachment to said sidewall, said apparatus comprising:

a plurality of supply nozzles for respectively supplying the plurality of materials to the container chambers;

a holder for holding the container with the container open end in an aligned relationship with the plurality of supply nozzles;

means for altering the position of the internal partitioning relative to the container sidewall so as to position the internal partitioning to permit each supply nozzle to enter a respective one of the plurality of chambers for discharge thereinto of a respective one of the plurality of materials.

2. A process for filling a plurality of flowable materials into a container having a sidewall, a closed end, an open end, and at least one internal flexible partitioning extending between the closed end and the open end to divide the container interior into a plurality of chambers so as to maintain the plurality of materials separated within the container, said at least one flexible partitioning having a first and a second side edge, each side edge attached to said sidewall, said internal flexible partitioning having a transverse dimension greater than the linear distance of the first side edge attachment to said sidewall and said second side edge attachment to said sidewall, said process comprising the steps of:

(a) positioning the container with a known orientation;

(b) positioning the internal partitioning with a desired orientation across the container;

(c) inserting a supply nozzle into each respective one of the plurality of chambers; and (d) injecting a known quantity of a respective material into each respective one of the plurality of chambers through the respective supply nozzles.

3. Apparatus for filling two flowable materials into a container having a sidewall, a closed end, an open end, and an internal flexible partition extending from the closed end to the open end to provide two chambers to maintain the two materials separated within the container, said flexible partitioning having a first and a second side edge, each side edge attached to said sidewall, said internal flexible partitioning having a transverse dimension greater than the linear distance of the first side edge attachment to said sidewall and said second side edge attachment to said sidewall, said apparatus comprising:

a first supply nozzle for supplying a first one of the two materials;

a second supply nozzle for supplying the other one of the two materials;

a holder for holding the container with the container open end in an aligned relationship with said first and second supply nozzles;

means for altering the position of the internal partition across the container so as to position the internal partition between said first supply nozzle and said second supply nozzle, permitting said first supply nozzle to enter a first one of the chambers for discharging thereinto of the first one of the two materials and permitting said second supply nozzle to enter the other one of the two chambers for discharging thereinto of the second one of the two materials.

4. Apparatus as claimed in claim 3, wherein said position altering means comprises a first probe member; a second probe member; and means for inserting said first probe member into the first one of the chambers, for inserting said second probe member into the second one of the chambers, and for pivoting one of (i) said first and second probe members and (ii) said holder and container, causing said probe members to stretch the internal partition across a predetermined portion of the container.

5. Apparatus as claimed in claim 3, wherein said position altering means comprises a first air nozzle; a second air nozzle; and means for positioning said first and second air nozzles adjacent opposite sides of the internal partition and causing air jets to blow from said air nozzles so as to position the partition substantially across the container.

6. Apparatus as claimed in claim 3, wherein said position altering means comprises a first probe member; a second probe member; and means for positioning said first and second probe members adjacent opposite sides of the internal partition and applying an electrostatic charge on said first and second probe members, inducing an electrostatic charge on the container sidewall and on the internal partition so that like electrostatic charges on the container sidewall and the internal partition cause the container sidewall and the internal partition to repel each other, moving the internal partition away from the container sidewall and toward the middle of the container.

7. Apparatus as claimed in claim 3, wherein said position altering means comprises an air/vacuum nozzle; and means for inserting said air/vacuum nozzle into one of the container chambers and alternately causing air to flow from said air/vacuum nozzle and suction to be drawn through said air/vacuum nozzle so as to move the internal partition to positions permitting insertion of said first supply nozzle into the first one of the container chambers and said second supply nozzle into the second one of the container chambers.

8. A process for filling two flowable materials into a container having a sidewall, a closed end, an open end and an internal flexible partition extending from the closed end to the open end to provide two chambers to maintain the two materials separated within the container, said flexible partitioning having a first and a second side edge, each side edge attached to said sidewall, said internal flexible partitioning having a transverse dimension greater than the linear distance of the first side edge attachment to said sidewall and said second side edge attachment to said sidewall, said process comprising the steps of:

(a) positioning the container with a known orientation;

(b) positioning the internal partition at a desired location within the container;

(c) inserting a first supply nozzle into a first one of the two chambers and discharging a known quantity of the first material into said first one of the two chambers; and (d) inserting a second supply nozzle into the other one of the two chambers and discharging a known quantity of the second material into said other one of the two chambers.

9. A process as claimed in claim 8, wherein steps (c) and (d) occur simultaneously.

10. A process as claimed in claim 8, wherein steps (c) and (d) occur sequentially.

11. A process as claimed in claim 8, wherein step (b) comprises:

inserting a first probe member into the first one of the two chambers;

inserting a second probe member into the other one of the two chambers; and pivoting one of (i) the first and second probe members, and (ii) the container, causing the probe members to stretch the internal partition across substantially the center of the container.

12. A process as claimed in claim 8, wherein step (b) comprises:

positioning a first air nozzle adjacent a first side of the internal partition;

positioning a second air nozzle adjacent a second side of the internal partition; and activating the first and second air nozzles to cause jets of air to blow therefrom so as to position the internal partition substantially across the container.

13. A process as claimed in claim 8, wherein step (b) comprises:

positioning a first probe member adjacent a first side of the internal partition;

positioning a second probe member adjacent a second side of the internal partition; and applying an electrostatic charge on said first and second probe members to induce an electrostatic charge on the container sidewall and on the internal partition so that like electrostatic charges on the container sidewall and the internal partition cause the container sidewall and the internal partition to repel each other, moving the internal partition away from the container sidewall and toward the middle of the container.

14. A process as claimed in claim 8, wherein step (b) comprises:

inserting an air/vacuum nozzle into one of the container chambers; and alternately causing air to blow from the air/vacuum nozzle and suction to be drawn through the air/vacuum nozzle so as to move the internal partition to positions permitting insertion of the first supply nozzle into the first one of the two chambers and the second supply nozzle into the second one of the two chambers.

15. Apparatus for orienting a container within a holder, the container having a sidewall, a closed end, an open end, and an internal flexible partition extending from the closed end to the open end to provide two chambers to maintain two materials separated within the container, so as to align the partition with respect to the holder, said apparatus comprising:

a first probe member;

a second probe member;

a holder for holding the container with the container open end in an aligned relationship with the first and second probe members, said holder having a predetermined internal configuration;

means forming at least a part of said first and second probe members, for altering the position of the internal partition relative to the container sidewall so as to position the internal partition between said first probe member and said second probe member, permitting said first probe member to enter a first one of the chambers and permitting said second probe member to enter the other one of the two chambers;

means for inserting said first probe member into the first one of the two chambers;

means for inserting said second probe member into the other one of the two chambers;

means for rotating one of (i) said holder and (ii) said first and second probe members while having the container within said holder with said first and second probe members inserted into the first and second chambers, respectively, so as to conform the shape of said container body to the predetermined configuration.

16. Apparatus as claimed in claim 15, wherein said position altering means comprises means for pivoting one of (i) said first and second probe members and (ii) said holder and container, causing said probe members to stretch the internal partition across substantially the center of the container.

17. Apparatus as claimed in claim 15, wherein said first and second probe members comprise respectively a first air nozzle and a second air nozzle; and said position altering means comprises means for positioning said first and second air nozzles adjacent opposite sides of the internal partition and causing air jets to blow from said air nozzles so as to position the partition across substantially the center of the container.

18. Apparatus as claimed in claim 15, wherein said position altering means comprises means for positioning said first and second probe members adjacent opposite sides of the internal partition and applying an electrostatic charge on said first and second probe members, inducing an electrostatic charge on the container sidewall and on the internal partition so that like electrostatic charges on the container sidewall and the internal partition cause the container sidewall and the internal partition to repel each other, moving the internal partition away from the container sidewall and toward the middle of the container.

19. Apparatus as claimed in claim 15, wherein one of said probe members comprises an air/vacuum nozzle; and said position altering means comprises means for inserting said air/vacuum nozzle into one of the container chambers and alternately causing air to flow from said air/vacuum nozzle and suction to be drawn through said air/vacuum nozzle so as to move the internal partition to positions permitting insertion of said first supply nozzle into the first one of the container chambers and said second supply nozzle into the second one of the container chambers.

20. A process for orienting a container within a holder, the container having a sidewall, a closed end, an open end, and an internal flexible partition extending from the closed end to the open end to provide two chambers to maintain two materials within the container, so as to align the partition with respect to the holder, said process comprising the steps of:

(a) positioning the container with the container open end adjacent a first probe member and a second probe member;

(b) positioning of the internal partition between said first probe member and said second probe member, permitting said first probe member to enter a first one of the chambers and said second probe member to enter the other one of the two chambers;

(c) inserting said first probe member into the first one of the two chambers;

(d) inserting said second probe member into the other one of the two chambers;

(e) rotating one of (i) said container and (ii) said first and second probe members with said first and second probe members inserted into the first and second chambers, respectively, so as to conform the shape of said container body to a predetermined configuration.

21. A process as claimed in claim 20, wherein step (b) comprises pivoting one of (i) said first and second probe members, and (ii) said container, causing the probe members to stretch the internal partition across substantially the middle of the container.

22. A process according to claim 20, wherein said first and second probe members comprise first and second air nozzles, and step (b) comprises activating the first and second air nozzles to cause jets of air to blow therefrom so as to position the internal partition across substantially the middle of the container.

23. A process according to claim 20, wherein step (b) comprises applying an electrostatic charge on said first and second probe members to induce an electrostatic charge on the container sidewall and on the internal partition so that like electrostatic charges on the container sidewall and the internal partition cause the container sidewall and the internal partition to repel each other, moving the internal partition away from the container sidewall and toward the middle of the container.

24. A process according to claim 20, wherein one of said probe members comprises an air/vacuum nozzle, and step (b) comprises causing suction to be drawn through a first one of the air/vacuum nozzles so as to move the internal partition to a position permitting insertion of the other one of the air/vacuum nozzles into the second one of the two chambers.

25. Apparatus for orienting a container within a holder, the container having a sidewall, a closed end, an open end, and an internal flexible partition extending from the closed end to the open end to provide two chambers to maintain two materials separated within the container, so as to align the partition with respect to the holder, said apparatus comprising:

a first probe member;

a second probe member;

a holder for holding the container with the container open end in an aligned relationship with the first and second probe members, said holder having a predetermined configuration;

means forming at least a part of said first and second probe members, for altering the position of the internal partition relative to the container sidewall so as to position the internal partition between said first probe member and said second probe member, permitting said first probe member to enter a first one of the chambers and permitting said second probe member to enter the other one of the two chambers;

means for inserting said first probe member into the first one of the two chambers;

means for inserting said second probe member into the other one of the two chambers; and means associated with said first probe member and said second probe member to orient said internal partition.

26. An apparatus as claimed in claim 25, wherein said means for inserting said first probe member and said means for inserting said second probe member operate simultaneously.

27. An apparatus as claimed in claim 25, wherein said means for inserting said first probe member and said means for inserting said second probe member operate sequentially.

28. An apparatus as claimed in claim 25, wherein said means to orient said internal partition comprises means to induce the same electrical charge on said container sidewall and said internal partition.

29. An apparatus as claimed in claim 25, wherein said means to orient said internal partition comprises means for applying a stream of gas against said internal partition.

30. An apparatus as claimed in claim 25, wherein said means to orient comprises means for applying a vacuum to said internal partition.

31. A process for orienting a container within a holder, the container having a sidewall, a closed end, an open end, and an internal flexible partition extending from the closed end to the open end to provide two chambers to maintain two materials within the container, so as to align the internal flexible partition with respect to the holder, said flexible partitioning having a first and a second side edge, each side edge attached to said sidewall, said internal flexible partitioning having a transverse dimension greater than the linear distance of the first side edge attachment to said sidewall and said second side edge attachment to said sidewall, said process comprising the steps of:

(a) positioning the container with the container open end adjacent a first probe member and a second probe member;

(b) positioning the internal partition between said first probe member and said second probe member, permitting said first probe member to enter a first one of the two chambers and said second probe member to enter the other one of the two chambers;

(c) inserting said first probe member into the first one of the two chambers;

(d) inserting said second probe member into the other one of the two chambers;

(e) orienting a middle portion of said internal partition to a distance from said sidewall.

32. A method as claimed in claim 31, wherein steps (c) and (d) occur simultaneously.

33. A method as claimed in claim 31, wherein steps (c) and (d) occur sequentially.

34. A method as claimed in claim 31, wherein step (e) comprises inducing the same electrical charge on said sidewall and on said internal partition.

35. A method as claimed in claim 31, wherein step (e) comprises directing a stream of gas from one of said first or second probe members against said internal partition.

36. A method as claimed in claim 31, wherein step (e) comprises drawing a vacuum on one of said first or second probe members.

* * * * *